US005834900A

United States Patent [19]

Tanaka et al.

[11] Patent Number: 5,834,900

[45] Date of Patent: Nov. 10, 1998

[54] FIELD EMISSION TYPE DISPLAY DEVICE AND METHOD FOR DRIVING SAME

[75] Inventors: Mitsuru Tanaka; Kazuyuki Suzuki, both of Mobara, Japan

[73] Assignee: Futaba Denshi Kogyo K.K., Mobara, Japan

[21] Appl. No.: 834,177

[22] Filed: Apr. 15, 1997

[30] Foreign Application Priority Data

Apr. 16, 1996 [JP] Japan ..... 8-117173

[51] Int. Cl.[6] ..... G09G 3/10

[52] U.S. Cl. ..... 315/169.1; 315/169.3; 315/169.4; 313/495; 345/74

[58] Field of Search ..... 315/169.4, 169.1, 315/169.3; 313/495–497, 336, 309, 351; 345/74–77

[56] References Cited

U.S. PATENT DOCUMENTS 5,015,912 5/1991 Spindt et al. ..... 313/495
5,449,970 9/1995 Kumar et al. ..... 313/495
5,557,159 9/1996 Taylor et al. ..... 315/169.3 X
5,572,041 11/1996 Betsui et al. ..... 345/74 X
5,585,301 12/1996 Lee et al. ..... 315/169.1 X
5,644,195 7/1997 Browning ..... 315/169.3

*Primary Examiner*—Benny Lee
*Assistant Examiner*—Haissa Philogene
*Attorney, Agent, or Firm*—Oblon, Spivak, McClelland, Maier & Neustadt, P.C.

[57] ABSTRACT

A field emission type display device capable of preventing a variation in luminance of the display device due to a variation in ambient temperature. A resistive layer is formed on cathode electrodes arranged in a display region and conical emitters are arranged on the resistive layer. The resistive layer is made of a semiconductor material, resulting in being varied in resistance depending on a temperature. A monitor resistive pattern made of the same material as the resistive layer is arranged so as to measure the resistance variation in the form of a voltage variation through an OP amplifier 11, which is then fed to the control circuit. The control circuit controls a gate voltage depending on the resistance to prevent a variation in luminance of the display device.

4 Claims, 4 Drawing Sheets

FIELD EMISSION TYPE DISPLAY DEVICE AND METHOD FOR DRIVING SAME

BACKGROUND OF THE INVENTION

This invention relates to a field emission type display device, and more particularly to a field emission type display device including cold cathodes and a method for driving the same.

When an electric field set to be about $10^9$ (V/m) is applied to a surface of a metal material or that of a semiconductor material, a tunnel effect occurs to permit electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode" (hereinafter also referred to as "FEC").

Recently, development of semiconductor integration techniques has led to manufacturing of an FEC as small as microns, which is typically known as an FEC of the Spindt type in the art. Manufacturing of such an FEC by semiconductor fine-processing techniques permits a distance between emitters of a conical shape or conical emitters and gate electrodes to be reduced to a level as small as less than a micron, so that application of a voltage of tens of volts between the conical emitters and the gate electrodes permits the conical emitters to emit electrons.

Also, the techniques ensure formation of the conical emitters while reducing pitches between the conical emitters to a level as small as 5 to 10 microns, to thereby permit tens of thousands to hundreds of thousands of FECs to be arranged on a single substrate.

Thus, the current semiconductor techniques satisfactorily provide an FEC of the surface emission type, so that it is proposed to apply the FEC to an electron source of the field emission type for a fluorescent display device, a CRT, an electron microscope, an electron beam equipment or the like.

A conventional FEC of the Spindt type is generally constructed as shown in FIG. 3. More specifically, the conventional FEC includes a glass substrate 100, a conductive cathode electrode 101 like a thin film formed on the glass substrate 100, a resistive layer 102 arranged on the cathode electrode 101, and an insulating layer 103 made of silicon dioxide or the like and arranged on the resistive layer 102. The gate electrode 104 and insulating layer 103 are formed with a plurality of common through-holes or apertures in a manner to commonly extend through both gate electrode 104 and insulating layer 103.

Thus, the resistive layer 102 has portions exposed through the apertures, and conical emitters 105 are formed on the exposed portions of the resistive layer 102.

Now, the reasons why the resistive layer 102 is arranged between the conical emitters 105 and the cathode electrode 101 in the thus-constructed FEC will be described.

In the FEC, the conical emitters are so arranged that a distal end thereof is spaced from the gate electrode at a distance as small as less than a micron as described above and tens of thousands to hundreds of thousands of conical emitters are arranged on the single substrate. Such arrangement of the conical emitters tends to cause short-circuiting between the conical emitters and the gate electrodes due to dust or the like entering therebetween. Even short-circuiting between only one of the conical emitters and the gate electrode leads to short-circuiting between the cathode electrode and the gate electrode, so that a voltage is kept from being applied to all conical emitters, resulting in the FEC failing to act as an electron source of the field emission type.

Also, the field emission type electron source causes gas to be emitted therefrom during an initial stage of operation. The gas emitted often leads to discharge between the conical emitters and the gate electrodes or anode electrodes, to thereby cause a current to flow in a large amount to the cathode electrodes, resulting in the cathode electrodes being fused.

Further, the conventional FEC has another disadvantage that a part of a number of the conical emitters tends to readily emit electrons as compared with the other conical emitters, resulting in electrons predominantly emitted the former conical emitters often forming spots of excessively increased luminance on an image plane.

Such arrangement of the resistive layer 102 between the cathode electrode 101 and the conical emitters 105 as shown in FIG. 3 is employed in order to avoid the above-described disadvantage. The thus-arranged resistive layer 102, when one of the conical emitters starts to emit electrons in an excessively increased amount due to non-uniformity in configuration thereof, permits a voltage drop to occur between the gate electrodes 104 and the cathode electrodes 101. The voltage drop causes a voltage applied to the conical emitter 105 which tends to discharge a current in an excessive amount to be reduced depending on the current discharged, to thereby restrain excessive electron discharge of the conical emitter, resulting in electron discharge of the conical emitters 105 being rendered stable or uniform, so that the above-described fusion of the cathode electrode 101 may be prevented.

More particularly, such a variation in Vg-Ie (gate voltage-emission current) characteristics as shown in FIG. 4 leads to a variation in emission current determined by intersections between a Vg-Ie curve and a load line, so that a voltage drop $\Delta_{drop}$ occurs in the conical emitters 105 having two Vg-Ie characteristics shown in FIG. 4.

Thus, arrangement of the resistive layer 102 as described above leads to an increase in yields of the FEC manufactured and ensures stable operation of the FEC.

In general, the resistive layer 102 is made of an amorphous silicon ($\alpha$-Si) material. The $\alpha$-Si material is a semiconductor and has an impurity added in a certain amount thereto to control a resistance of the resistive layer 102, resulting in a variation in electrons emitted from the conical emitters being restrained.

In general, a resistance of a semiconductor has a negative temperature coefficient and tends to be reduced with an increase in temperature. The $\alpha$-Si material exhibits like characteristics, as shown in FIG. 5. More particularly, it has a resistance R reduced logarithmically depending on a temperature variation T as shown in FIG. 5, wherein an axis of ordinates is a logarithmic scale. Thus, a variation in ambient temperature or temperature of an ambient atmosphere in which the FEC is placed leads to a variation in resistance of the resistive layer 102 and therefore a resistance of the emitters, so that a voltage drop at a resistive portion of the emitters is varied.

Such a variation in voltage drop causes a variation in gate-emitter voltage VGE applied to the emitters, resulting in an emission current discharged from the conical emitters 105 being drastically varied due to the temperature variation, as shown in FIG. 6. In FIG. 6, curves a to f indicate I-V characteristics, wherein the curve a indicates characteristics obtained when the temperature is kept at a lowermost level and the curve f indicates characteristics obtained when it is at an uppermost level. Thus, FIG. 6 indicates that the anode current Ia is drastically increased with an increase in temperature. Therefore, the conventional FEC has a disadvantage that luminance of a display device in which the FEC is incorporated is varied with a variation in ambient temperature.

Also, such a variation in emission current depending on the temperature causes the anode current Ia at an increased temperature to be several times as large as the rated current, so that an anode current source for feeding the anode current to anode electrodes is required to have an increased capacity, leading to problems such as an increase in power consumption, an increase in power cost and the like.

SUMMARY OF THE INVENTION

The present invention has been made in view of the foregoing disadvantage of the prior art.

Accordingly, it is an object of the present invention to provide a field emission type display device which is capable of preventing a variation in luminance due to an increase in ambient temperature.

It is another object of the present invention to provide a method for driving a field emission type display device which is capable of preventing a variation in luminance of the display device due to an increase in ambient temperature.

In accordance with one aspect of the present invention, a field emission type display device is provided. The field emission type display device includes a cathode substrate including a field emission section and an anode substrate including a luminous section and arranged so as to be opposite to the cathode substrate. The cathode substrate and anode substrate cooperate with each other to provide a vacuum atmosphere therebetween and the field emission section includes a resistive layer arranged between cathode electrodes and emitters for emitting electrons. The display device also includes a monitor resistive pattern for measuring a resistance of the resistive layer. The monitor resistive pattern is made of the same material as the resistive layer by the same processing as the resistive layer.

In accordance with another aspect of the present invention, a method for driving a field emission type display device is provided. The method is adapted to a field emission type display device which includes a cathode substrate including a field emission section and an anode substrate including a luminous section and arranged so as to be opposite to the cathode substrate, to thereby cooperate with the cathode substrate to provide a vacuum atmosphere therebetween, wherein the field emission section including a resistive layer arranged between cathode electrodes and emitters for emitting electrons. The method comprises the step of detecting a resistance of the resistive layer to control a drive voltage depending on the resistance detected, resulting in luminance of the luminous section being kept from being varied.

In a preferred embodiment of the present invention, the resistance of the resistive layer is detected by a monitor resistive pattern made of the same material as the resistive layer by the same processing as the resistive layer.

Also, in a preferred embodiment of the present invention, a differential voltage of a constant level is held between gate voltages and cathode voltages irrespective of controlling of the drive voltage.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 2(*b*) is a graphical representation showing temperature-anode current characteristics of a field emission type display device of the present invention while indicating results of temperature compensation in driving of the device;

DETAILED DESCRIPTION OF THE PREFERRED EMBODIMENT

Now, the present invention will be described hereinafter with reference to the accompanying drawings.

Figure 1:
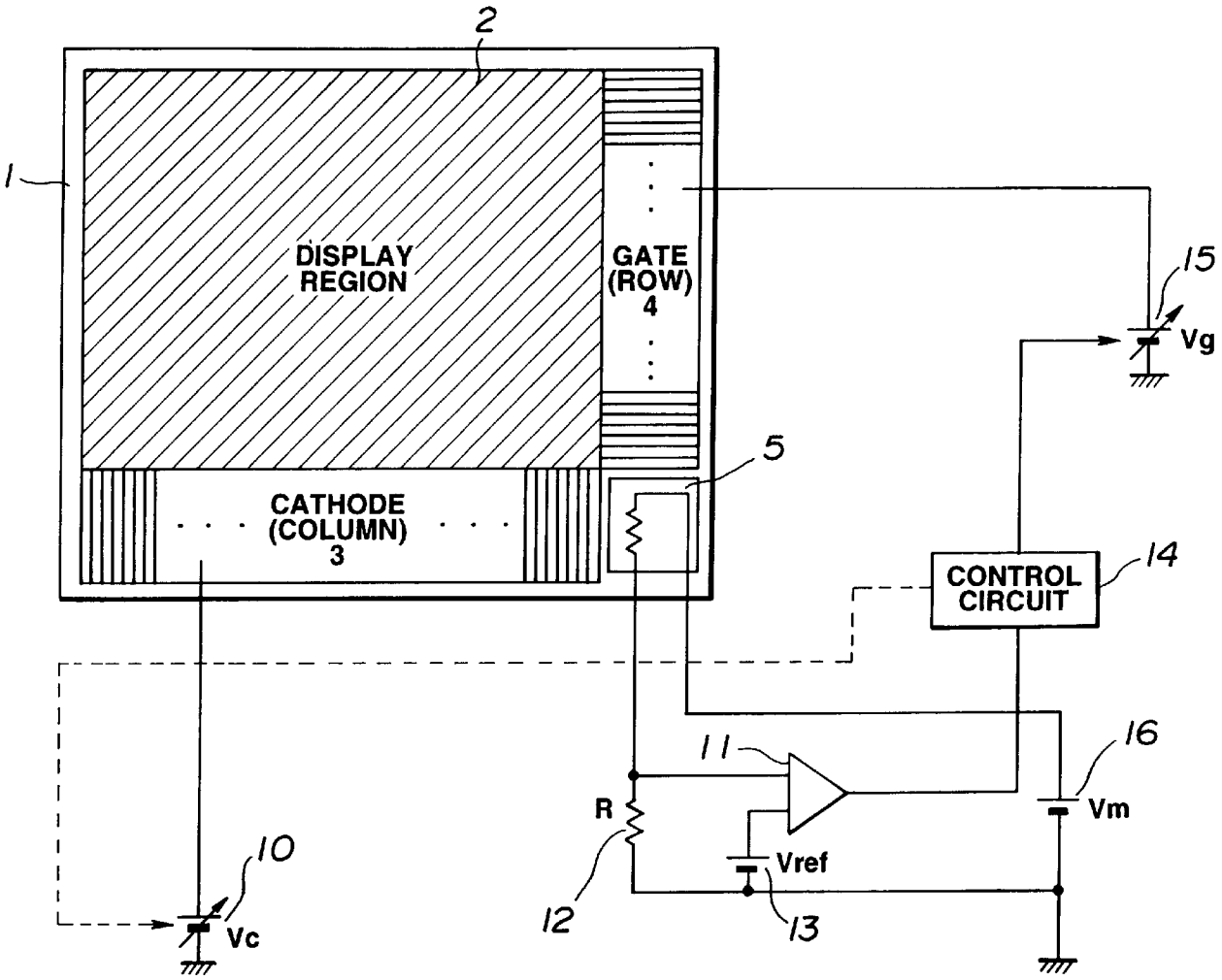
FIG. 1 is a diagrammatic view showing the manner of driving of an embodiment of a field emission type display device according to the present invention.
Figure 3:
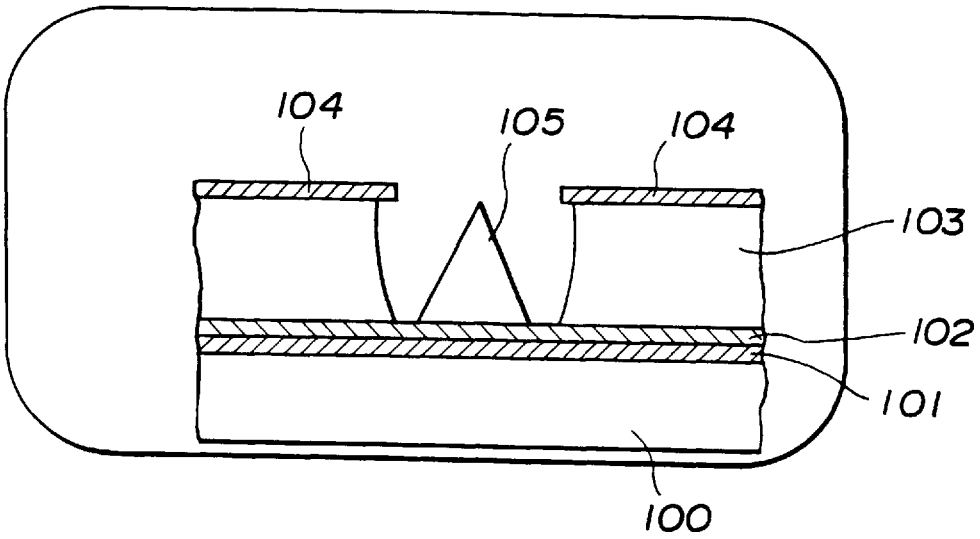
PRIOR ART FIG.3
FIG. 3 is a fragmentary schematic sectional view showing a conventional field emission cathode of the Spindt type.
Figure 4:
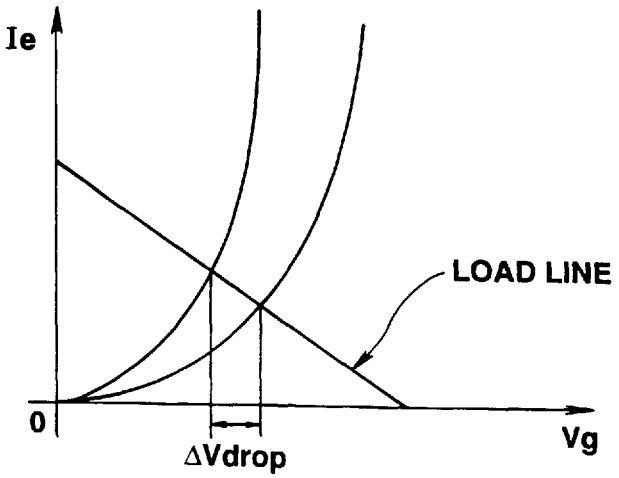
PRIOR ART FIG.4
FIG. 4 is a graphical representation showing Vg-Ia characteristics of a conventional field emission cathode of the Spindt type.

Referring first to FIG. 1, the manner of driving of an embodiment of a field emission type display device according to the present invention is illustrated. In FIG. 1, reference numeral 1 designates a cathode substrate, which is formed thereon with tens of thousands of field emission cathodes each including a resistive layer, which may be manufactured in the same manner as shown in FIG. 3. Reference numeral 2 is a display region in which such field emission cathodes are arranged, 3 is stripe-like cathode electrodes or column electrodes arranged under the resistive layer so as to constitute a plurality of columns, and 4 is stripe-like gate electrodes or row electrodes arranged on an insulating layer and constituting a plurality of rows.

Reference numeral 5 is a monitor resistive pattern made of the same material as the resistive layer provided under conical emitters arranged in the display region. The monitor resistive pattern 5 is formed simultaneously with formation of the resistive layer by the same processing as the resistive layer. 10 is a cathode voltage source for applying a cathode voltage Vc to the cathode electrodes 3, 11 is an OP amplifier for converting a resistance of the monitor resistive pattern 5 into a voltage to output a detection signal, 12 is a detection resistor (R) which is connected in series to the monitor resistive pattern 5 and across which a voltage is varied with a variation in resistance thereof, 13 is a reference voltage source for generating a reference voltage Vref set depending on a resistance of the monitor resistive pattern 5, 14 is a control circuit for controlling a value of a gate voltage Vg depending on the detection signal outputted from the OP amplifier, and 16 is a measuring voltage source applying a measuring voltage Vm to a series circuit of the monitor resistive pattern 5 and detection resistor 12.

Now, the manner of operation of the field emission type display device of the illustrated embodiment thus constructed will be described.

For example, the gate electrodes 4 are selectively driven row by row in order, so that the conical emitters in the display region 2 corresponding to the gate electrodes 4 driven emit electrons depending on a cathode voltage Vc applied to the cathode electrodes 3. The electrons emitted then travel to an anode substrate arranged so as to be opposite to the cathode substrate 1 and spaced therefrom at a micro distance as small as, for example, 200 microns. Then, the electrons impinge on phosphors coated on the anode substrate to excite them, so that the phosphors emit light. Luminance of the phosphors obtained at this time depends on the amount of electrons emitted or the amount of an emission current.

Thus, feeding of a video signal to the cathode electrodes 3 in synchronism with scanning of the gate electrodes 4 permits the phosphors corresponding thereto to carry out a display in the display region 2. A space between the cathode substrate 1 and the anode substrate is evacuated to a vacuum.

At this time, a resistance of the resistive layer is varied depending on an ambient temperature or a temperature of an ambient atmosphere in which the field emission type display device is placed. A variation like a variation in resistance of the resistive layer likewise appears in the monitor resistive pattern 5 formed by the same processing.

A variation in resistance of the monitor resistive pattern 5 leads to a variation in a divided voltage value of the measuring voltage Vm by the monitor resistive pattern 5 and detection resistor 12, so that a variation in resistance of the resistive layer may be detected by detecting a voltage across the detection resistor 12.

Thus, the divided voltage of the measuring voltage Vm by the detection resistor 12 is inputted to, for example, to a non-inversion input terminal of the OP amplifier 11. The non-inversion input terminal of the OP amplifier 11 has the reference voltage Vref applied thereto, so that a differential voltage between both voltages inputted is outputted from the OP amplifier 11. The thus-outputted differential voltage is then fed in the form of a detection signal to the control circuit 14, so that the control circuit 14 controls the gate voltage Vg depending on the detection signal.

The reference voltage Vref is for the purpose of setting a range of a temperature to be measured and has a value variably determined depending on a material for the resistive layer.

Figure 5:
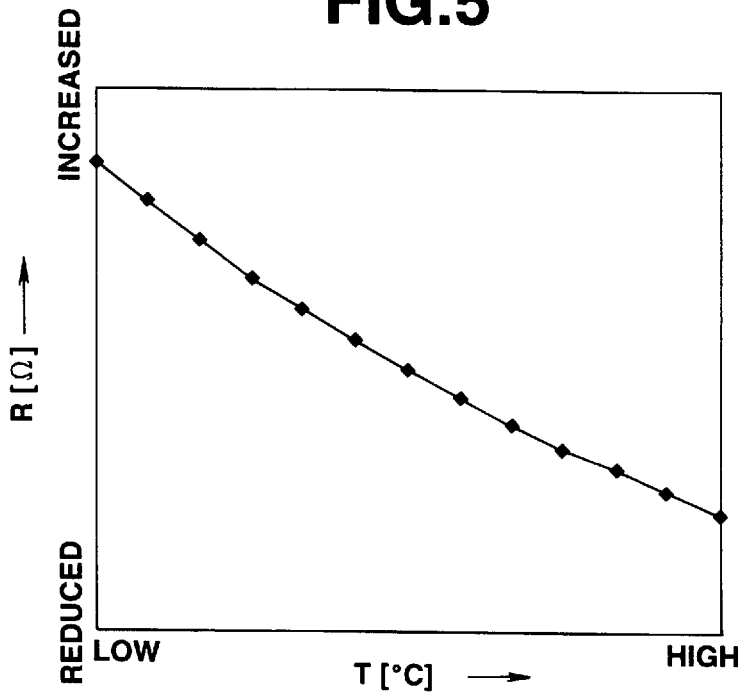
FIG. 5 is a graphical representation showing relationship between a resistance of amorphous silicon and a temperature.
Figure 6:
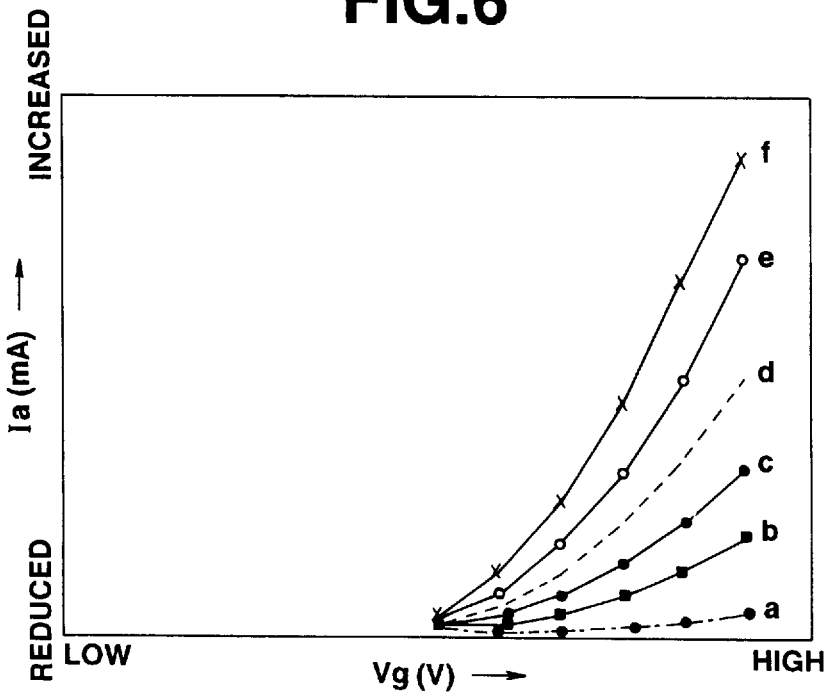
FIG. 6 is a graphical representation showing I-V characteristics of a field emission cathode.

A resistance of the resistive layer is logarithmically varied as shown in FIG. 5 and the anode current is exponentially varied with respect to the gate voltage as shown in FIG. 6, so that a variation in luminance may be minimized or restrained by substantially linearly varying the gate voltage Vg with respect to the temperature variation. Thus, the control circuit 14 is merely required to output a linear control signal to the detection signal, resulting in being simplified in structure.

The control signal of the control circuit 14 may be outputted on the basis of a certain function rather than linearly.

The gate voltage Vg is controlled so as to be increased because a resistance of the resistive layer is increased in a low temperature region. This results in a display contrast being reduced. This is due to the fact that drive conditions of the cathode electrodes with respect to a cut-off voltage are deviated from a set point. In view of the foregoing, in order to prevent a variation in display contrast due to temperature compensation of the luminance, the cathode voltage Vc is controlled in association with a variation in gate voltage Vg by means of the control signal of the control circuit 14 as indicated at a broken line. This permits the differential voltage (Vg-Vc) between the gate voltage Vg and the cathode voltage Vc to be kept substantially constant irrespective of controlling of the gate voltage Vg, to thereby restrain or minimize a variation in display contrast.

Thus, it will be noted that the illustrated embodiment accomplishes the temperature compensation without varying the contrast, irrespective of an ambient temperature of the field emission display device.

Figure 2A:
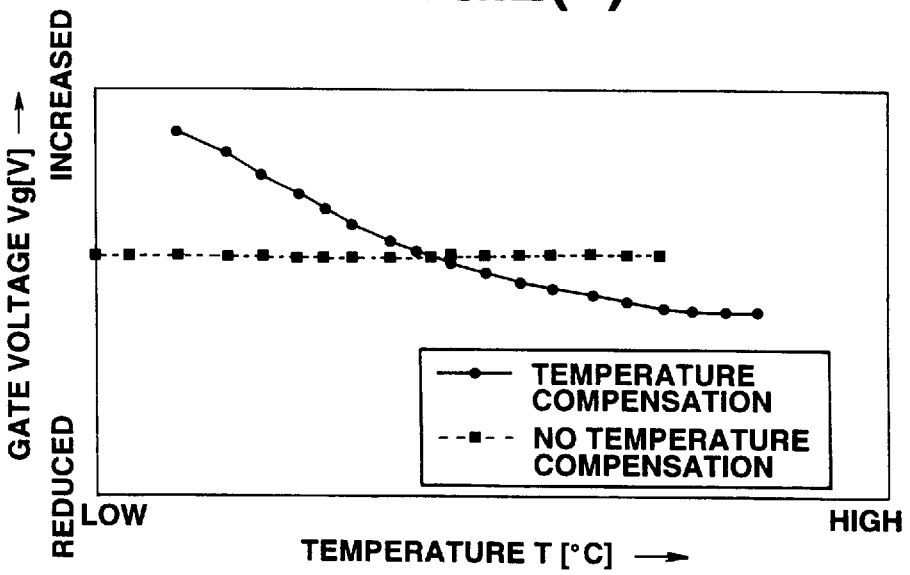
FIG. 2(*a*) is a graphical representation showing temperature-gate voltage characteristics of a field emission type display device of the present invention while indicating results of temperature compensation in driving of the device.
Figure 2B:
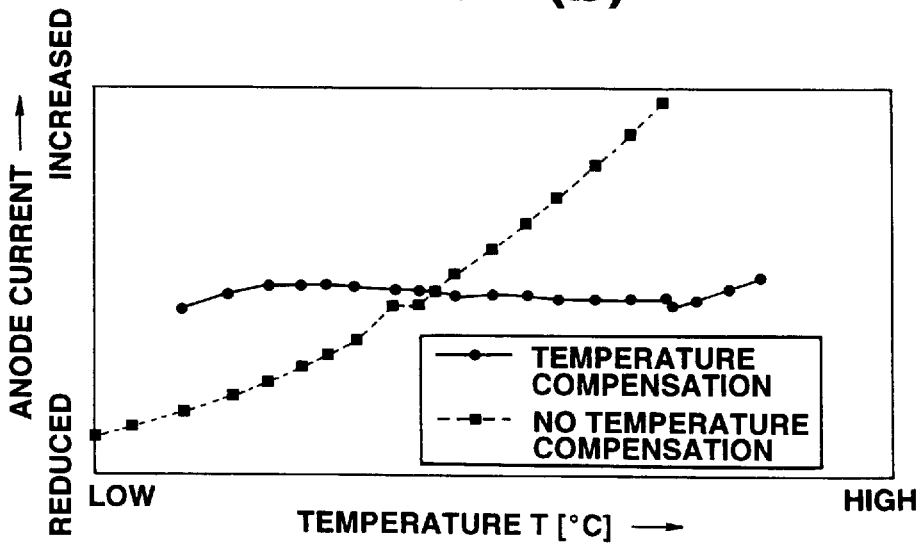

Results of the temperature compensation by the present invention are shown in FIGS. 2(*a*) and 2(*b*). FIG. 2(*a*) indicates temperature-gate voltage characteristics of the field emission display device. When the temperature compensation is not carried out, the gate voltage Vg is kept constant with respect to the temperature variation as indicated at a broken line; whereas execution of the temperature compensation causes the gate voltage Vg to be decreased with an increase in temperature as indicated at a solid line.

FIG. 2(*b*) shows temperature-anode current characteristics of the field emission display device. When the temperature compensation is not carried out, the anode current Ia is increased with respect to the temperature variation as indicated at a broken line; whereas practicing of the temperature compensation permits the anode current Ia to be rendered constant irrespective of the temperature variation as indicated at a solid line.

Thus, it will be noted that the illustrated embodiment controls luminance of the field emission type display device so that it is kept substantially constant irrespective of the temperature variation.

In the illustrated embodiment, a resistance of the resistive layer is detected by the monitor resistive pattern. Alternatively, it may be detected by a temperature sensor.

The resistive layer may be made of amorphous silicon doped with an impurity. The impurities may include P, Bi, Ga, In, Tl and the like.

As can be seen from the foregoing, the present invention is so constructed that a resistance of the resistive layer varied depending on a temperature of an ambient atmosphere in which the display device is placed is detected by means of the monitor resistive pattern made of the same material as the resistive layer by the same processing as the resistive layer. Such construction permits the drive voltage to be controlled depending on the resistance detected, to thereby prevent luminance of the field emission type display device from being varied depending on a variation in ambient temperature.

In this instance, when the present invention is constructed so as to render a differential voltage between the gate voltage and the cathode voltage constant, a variation in contrast in a display of the field emission type display device may be prevented irrespective of controlling of the ambient temperature.

Further, it is merely required to linearly vary the gate voltage with respect to the temperature variation, so that the control circuit for controlling the gate voltage may be simplified in structure. Moreover, the anode current is permitted to be substantially constant, therefore, it is not required to increase a capacity of anode power supply, leading to a decrease in power consumption and a cost reduction.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A field emission type display device comprising:

a cathode substrate including a field emission section;

an anode substrate including a luminous section and arranged so as to be opposite to said cathode substrate;

said cathode substrate and anode substrate cooperating with each other to provide a vacuum atmosphere therebetween;

said field emission section including a resistive layer arranged between cathode electrodes and emitters for emitting electrons; and a monitor resistive pattern for measuring a resistance of said resistive layer;

said monitor resistive pattern being made of the same material as said resistive layer by the same processing as said resistive layer.

2. A method for driving a field emission type display device which includes a cathode substrate including a field emission section and an anode substrate including a luminous section and arranged so as to be opposite to said cathode substrate, to thereby cooperate with said cathode substrate to provide a vacuum atmosphere therebetween, said field emission section including a resistive layer arranged between cathode electrodes and emitters for emitting electrons, comprising the step of:

detecting a resistance of said resistive layer to control a drive voltage depending on the resistance detected, resulting in luminance of said luminous section being kept from being varied.

3. A method as defined in claim 2, wherein the resistance of said resistive layer is detected by a monitor resistive pattern made of the same material as said resistive layer by the same processing as said resistive layer.

4. A method as defined in claim 2, wherein a differential voltage of a constant level is held between gate voltages and cathode voltages irrespective of controlling of said drive voltage.

* * * * *